US006788911B2

(12) United States Patent
Ishiyama et al.

(10) Patent No.: US 6,788,911 B2
(45) Date of Patent: Sep. 7, 2004

(54) CHARGING APPARATUS, PROCESS CARTRIDGE AND IMAGE FORMING APPARATUS

(75) Inventors: Harumi Ishiyama, Numazu (JP); Yasunori Chigono, Susono (JP); Jun Hirabayashi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 26 days.

(21) Appl. No.: 10/140,982

(22) Filed: May 9, 2002

(65) Prior Publication Data

US 2003/0002888 A1 Jan. 2, 2003

(30) Foreign Application Priority Data

May 9, 2001 (JP) ..... 2001-138414

(51) Int. Cl.[7] ..... G03G 15/02
(52) U.S. Cl. ..... 399/175; 399/50
(58) Field of Search ..... 361/221, 225; 399/149, 150, 174, 175, 176, 50; 430/105, 108.1, 902

(56) References Cited

U.S. PATENT DOCUMENTS 5,579,095 A 11/1996 Yano et al.
5,754,927 A 5/1998 Ishiyama et al. ..... 399/176
5,822,659 A 10/1998 Ishiyama ..... 399/175
6,081,681 A 6/2000 Nagase et al. ..... 399/174
6,128,456 A 10/2000 Chigono et al. ..... 399/176
6,134,407 A 10/2000 Ishiyama et al. ..... 399/174
6,163,670 A * 12/2000 Gomi et al. ..... 399/175
6,289,190 B1 9/2001 Amamiya et al. ..... 399/174
6,553,199 B2 * 10/2001 Ishiyama et al. ..... 399/174

* cited by examiner

*Primary Examiner*—Hoang Ngo
(74) *Attorney, Agent, or Firm*—Fitzpatrick, Cella, Harper & Scinto

(57) ABSTRACT

A charging device includes a charging member for electrically charging a member to be charged which is adapted to form a nip with a member to be charged which has a surface layer having a volume resistivity of $1\times10^{9}$–$1\times10^{14}$ Ωcm, said charging member having an elastic member and movable with a peripheral speed difference relative to the member to be charged; and electroconductive particles carried on said charging member to the nip, wherein a peripheral speed Vd (mm/sec) of said member to be charged, a peripheral speed Vc (mm/sec) of said charging member, a width N (mm) of the nip measured in a moving direction of said charging member, and a coverage ratio Rc of said electroconductive particles on said charging member, satisfy:

$$N\cdot Rc\cdot|Vc-Vd|/Vd\geqq 1.$$

16 Claims, 4 Drawing Sheets

CHARGING APPARATUS, PROCESS CARTRIDGE AND IMAGE FORMING APPARATUS

FIELD OF THE INVENTION AND RELATED ART

The present invention relates to a charging apparatus which employs a contact type charging method which utilizes electrically conductive particles. It also relates to a process cartridge.

In the past, a corona based charging apparatus (corona discharger) has been widely used as a charging apparatus for uniformly charging (or discharging) an image bearing member (object to be charged), such as electrophotographic photoconductive member or an electrostatically recordable dielectric member, in an image forming apparatus such as an electrophotographic apparatus or an electrostatic recording apparatus.

In recent years, a contact type charging apparatus (contact charging apparatus) which employs a contact charging method, has been put to practical use, because a contact charging apparatus is advantageous over a corona discharger in that the former produces a smaller amount of by-products such as ozone, and also has less power consumption, than the latter. According to this contact charging method, an object is charged by placing a charging member in contact with the object to be charged, while applying voltage to the charging member.

However, in principle, even a contact charging apparatus produces active ions such as ozone, although only an extremely small amount compared to a corona discharger. In other words, it is not completely free from the problems related to the production of an active ion such as ozone.

In order to solve the above described problems, an injection charge mechanism has been proposed, which will be described next.

The injection charge mechanism charges the surface of an object by injecting electric charge directly from a contact charging apparatus into the object. This mechanism has been disclosed in U.S. Pat. Nos. 6,134,407, 6,081,681, 6,128,456, and, the like.

In the injection charge mechanism, electric charge is directly injected into the peripheral surface of an object be charged, by placing a contact charging member, the electrical resistance of which is in the mid range, in contact with the peripheral surface of the object. Thus, in principle, electric discharge and the mechanism therefor are not involved in the charging of the object. Therefore, even when the value of the voltage applied to the contact charging member is no more than the threshold value, the object can be charged to a potential level equivalent to the value of the voltage applied to the contact charging member. FIG. 5 shows the comparison in charge characteristic between an injection-based charging mechanism (solid line B) and corona-based charging mechanism (broken line A), that is, the conventional charging mechanism. The charging mechanism based on direct injection is not accompanied by ion production. Therefore, it does not suffer from the problems caused by the byproducts of electric discharge.

More concretely, the direct injection charging mechanism is such a charging mechanism in which electric charge is directly injected into the traps in the peripheral surface of an object (image bearing member) to be charged, or into the constituents, such as electrically conductive particles, of the charge injection layer of the object (image bearing member), by applying voltage to a contact charging member such as a magnetic brush. In the direct injection charging mechanism, electric discharge is not the dominant factor. Therefore, the value of the voltage necessary for charging an object (image bearing member) has only to be equal to the value of the desired voltage level to which the peripheral surface of the image bearing member is to be charged, and in addition, it produces a very small amount of ozone.

In the case of a magnetic brush employed as a charging member, it is conceivable to make the particle size of the magnetic particles microscopic in order to improve the magnetic brush in terms of the uniformity with which an object is charged. However, if the particle size of the magnetic particles is simply reduced to the microscopic level, it becomes easier for the magnetic particles to fall off the charging device. If the microscopic magnetic particles fall off the charging device, they mix into the developing device, adversely affecting the performance of the developing device, and also, they appear, as parts of a completed image, on a recording medium through the transfer and fixing processes, degrading the image quality. In order to prevent the magnetic particles from falling off the charging device, it is possible to improve the magnet in terms of magnetic force, that is, the magnetic toner retaining force, and/or to improve the magnetic particles in terms of magnetic properties. However, both ideas lead to cost increases.

In other words, the magnetic brush is difficult to further improve in terms of charge uniformity.

Thus, a few proposals have been made as means for improving the magnetic brush, as a charging member, in terms of charge uniformity. According to one of them, a porous roller, for example, a sponge roller, as a contact member for directly injecting electric charge, is coated with electrically conductive microscopic particles (which hereinafter way be referred to simply as conductive particles) in order to improve the contact charging member. This structural arrangement provides virtually ideal contact (electrical contact), between a contact charging member and an object to be charged, enabling the contact charging member to satisfactorily charge the object.

SUMMARY OF THE INVENTION

The primary object of the present invention is to provide: a charging apparatus, which employs a charging method virtually free of byproducts such as ozone, and is superior in charge uniformity; a process cartridge, which employs such a charging apparatus; and an image forming apparatus, which employs such a charging apparatus or such a process cartridge.

Another object of the present invention is to provide: a charging apparatus, the performance of which in terms of charge uniformity remains stable for a long period of usage; a process cartridge, which employs such a charging apparatus; and an image forming apparatus, which employs such a charging apparatus or such a process cartridge.

Another object of the present invention is to provide: a charging apparatus, which is capable of providing an optimal state of contact between the charging device and object to be charged; a process cartridge employing such a charging apparatus; and an image forming apparatus employing such a charging apparatus or such a process cartridge.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Figure 1:
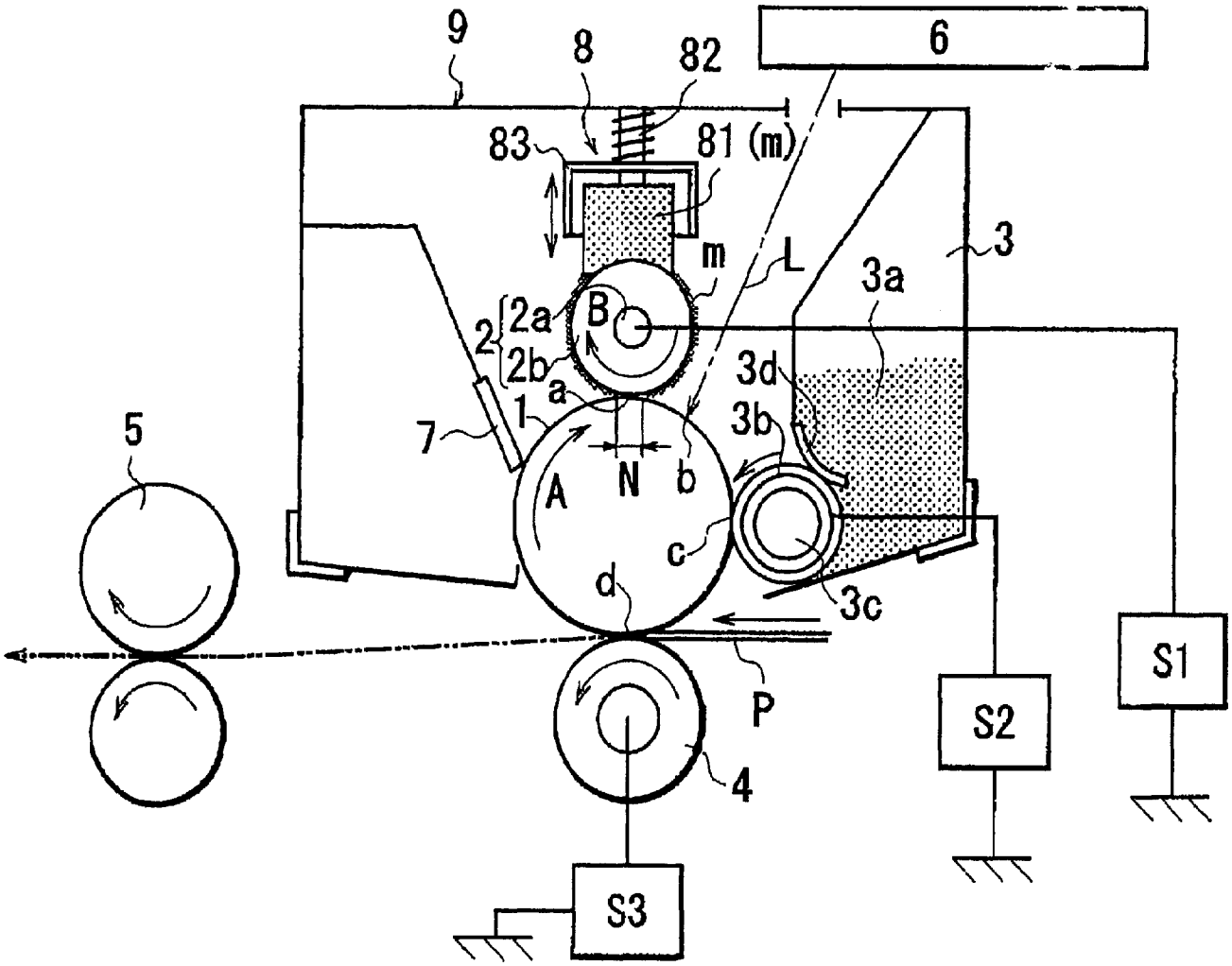
FIG. 1 is a schematic drawing for showing the general structure of the image forming apparatus in the first embodiment of the present invention.
Figure 2:
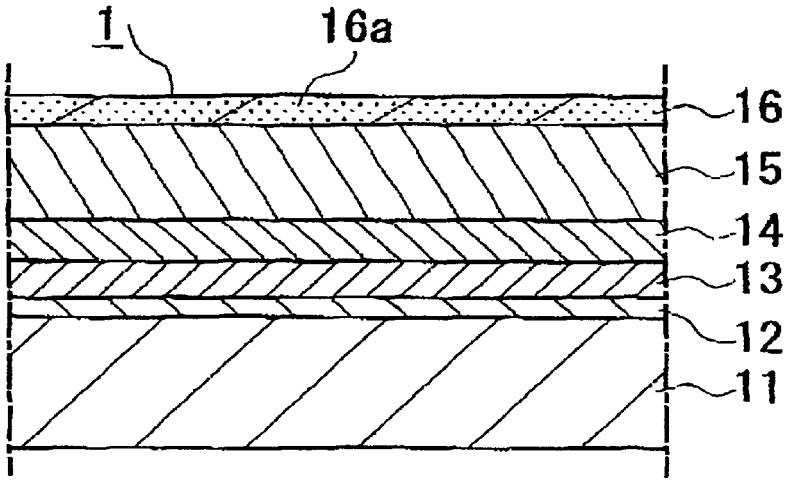
FIG. 2 is a schematic drawing for showing the laminar structure of the photoconductive drum employed by the image forming apparatus shown in FIG. 1.
Figure 3:
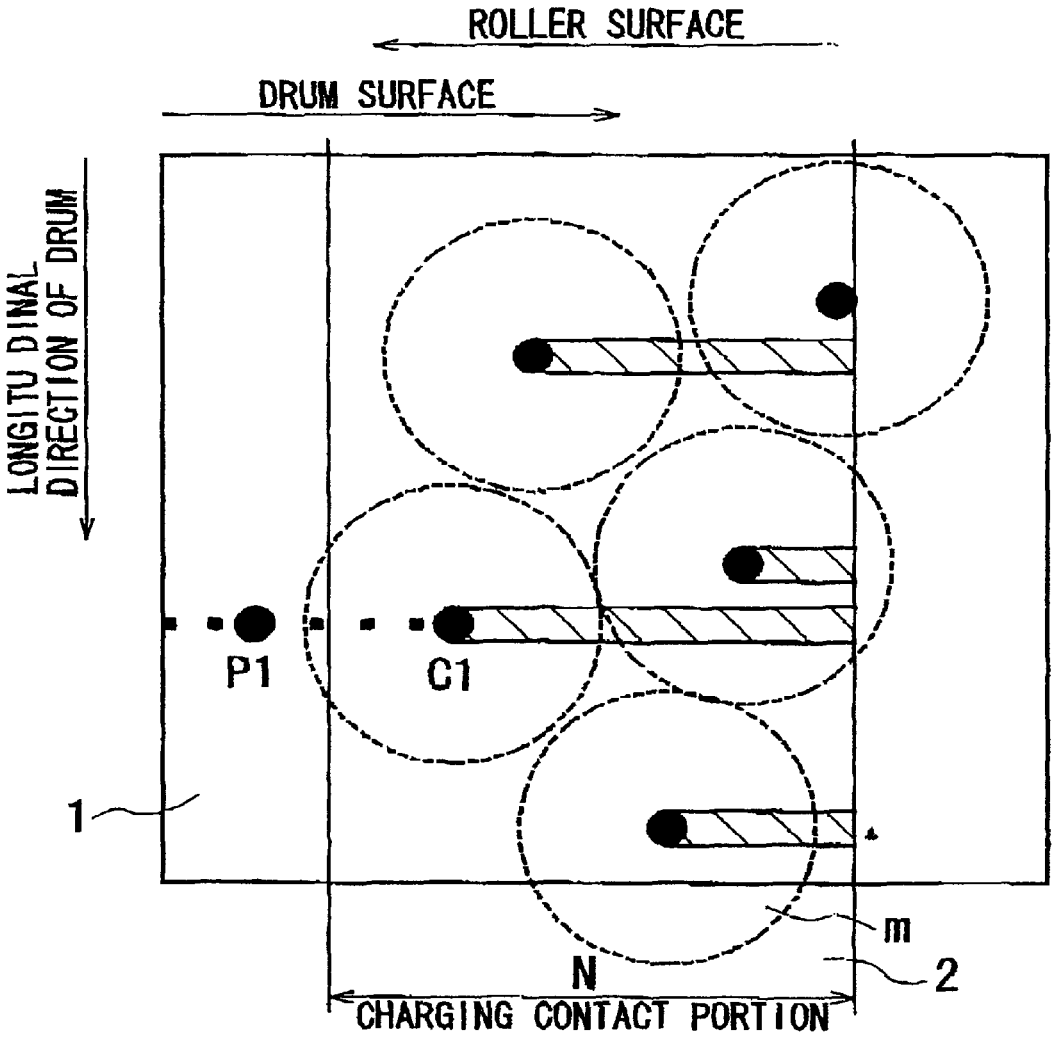
FIG. 3 is a schematic drawing showing the development of the charging nip portion of the photoconductive drum in accordance with the present invention, and its adjacencies.

<Embodiment 1> (FIGS. 1–3)

FIG. 1 is a schematic drawing for showing the general structure of the image forming apparatus in accordance with the present invention. The image forming apparatus in this embodiment is a laser-beam printer, which employs a transfer-type electrophotographic process, a direct injection-type charging method employing electrically conductive particles (which hereinafter will be referred to conductive charging particles), a reversal developing method, and a process cartridge system.

(1) General Structure of Printer

A referential code 1 stands for an electrophotographic photoconductive member (which hereinafter will be referred to as photoconductive drum), as an object to be charged, which is in the form of a drum and is 30 mm in diameter. A referential code 2 stands for an electrically conductive charge roller (which hereinafter will be referred to as charge roller) as a contact charging member. A referential code 3 stands for a developing device. A referential code 4 stands for a transfer roller as a transfer charger. A referential code 5 stands for an image fixing apparatus. A referential code 6 stands for a laser beam scanner as an image exposing device. Referential codes 7, 8, and 9 stand for a cleaning apparatus, a conductive charging particles supplying means, and a process cartridge, respectively.

(A) Charging Process

The photoconductive drum 1 is rotationally driven in the clockwise direction indicated by an arrow mark A at a predetermined surface velocity (peripheral velocity: process speed) of Vd mm/sec. The charge roller 2 has been coated in advance with the conductive charging particles. As the charge roller 2 is rotated, it is coated with the conductive charging particles, by the conductive charging particle supplying means 8. The charge roller 2 is kept in contact with the photoconductive drum 1 with the application of a predetermined amount of pressure, forming a nip (charging nip), that is, a charging station, and electric charge is directly injected into the photoconductive drum 1 by the charge roller 2, uniformly charging the peripheral surface of the photoconductive drum 1 to the predetermined polarity, and a predetermined potential level, which in this embodiment is approximately −700 V.

The charge roller 2 is rotationally driven at a predetermined surface velocity (peripheral velocity) of Vc mm/sec, in such a direction that in the charging station a, that is, the nip between the photoconductive drum 1 and charge roller 2, the moving direction B of the peripheral surface of the charge roller 2 becomes counter to the moving direction A of the peripheral surface of the photoconductive drum 1.

(B) Image Exposing Process

In the image exposure station b, the uniformly charged surface of the photoconductive drum 1 is exposed to a scanning laser beam, that is, the exposure light from a laser beam scanner 6. As a result, an electrostatic latent image reflecting the print pattern (image data) of an intended image is formed.

The laser beam scanner 6 comprises a laser diode, a polygon mirror, and the like, and outputs the laser beam L while modulating it in intensity with sequential digital electric picture element signals reflecting the print pattern, so that the uniformly charged peripheral surface of the photoconductive drum 1 is scanned (exposed) by the laser beam L.

(C) Development Process

The electrostatic latent image on the peripheral surface of the rotating photoconductive drum 1 is reversely developed into a toner image by the developing device 3, in the development station c.

The developing device 3 in this embodiment is a reversal developing device, which employs single-component negative magnetic toner as a developer 3*a*.

Designated by a referential code 3*b* is a nonmagnetic development sleeve as a developer bearing/conveying member, which is rotationally driven in the counterclockwise direction indicated by the arrow mark at the predetermined peripheral velocity.

A referential code 3*c* stands for a nonrotational magnetic roll, which is positioned in the hollow of the development sleeve 3*b*. The developer 3*a* in the adjacencies of the development sleeve 3*b* in the developing device developing device 3 is borne, as a magnetic brush layer, on the peripheral surface of the development sleeve 3*b*, by the magnetic force of the magnetic roll 3*c*, and is conveyed by the rotation of the development sleeve 3*b*. As the layer of the developer 3*a* on the peripheral surface of the development sleeve 3*b* is conveyed, it is regulated in thickness, while being given triboelectric charge, by the regulating blade 3*d*. After being regulated in thickness and triboelectrically charged by the development blade 3*d*, the layer of the developer 3*a* on the peripheral surface of development sleeve 3*b* is further conveyed to the development station c, in which the peripheral surfaces of the photoconductive drum 1 and development sleeve 3*b* directly oppose each other.

To the development sleeve 3*b*, a predetermined development bias is applied from a development bias power source S2. The development bias in this embodiment was a combination of DC and AC voltages:

DC voltage: −500 V

AC voltage: 1600 V in peak-to-peak voltage; 1.8 kHz in frequency; and rectangular in waveform.

As a result, the negative toner is selectively adhered to the peripheral surface of the photoconductive drum 1; the negative toner is adhered to the exposed areas of the peripheral surface of the photoconductive drum 1 (light areas of electrostatic latent image). As a result, the electrostatic latent image is reversely developed.

The single-component magnetic toner 3*a*, as developer, contains bonding resin. magnetic particles, a charge control agent, and the like. In order to produce this single-component magnetic toner 3*a*, the above listed ingredients are subjected to various processes, for example, mixing, kneading, pulverizing, classifying, and the like processes, and then, external additives, such as a fluidizing agent, are added. The single-component magnetic toner 3*a* in this embodiment was 7 $\mu$m in average particle diameter (D).

(D) Transfer Process

The toner image on the peripheral surface of the rotating photoconductive drum 1 is continually transferred onto the surface of a recording medium P, in the transfer station d (transfer nip), which is the contact area (interface) between the peripheral surfaces of the transfer roller 4 and photoconductive drum 1. The electrical resistance of the transfer roller 4 is in the mid range.

To this transfer station d, the recording medium P is delivered from an unshown sheet feeding station, with a predetermined timing. After being delivered to the transfer station d, the recording medium P is conveyed, remaining pinched by the transfer roller 4 and photoconductive drum 1, through the transfer station d. To the transfer roller 4, a predetermined transfer bias voltage is applied from a transfer bias voltage application power source S3, while the recording medium P is conveyed through the transfer station d. As a result, the toner image on the peripheral surface of the photoconductive drum 1 is electrostatically transferred onto the surface of the recording medium P, continuously starting from the leading end in terms of the recording medium conveyance direction. The transfer bias voltage in this embodiment was a DC voltage of +2 kV.

(E) Fixing Process

After coming out of the transfer station d, the recording medium P is separated from the peripheral surface of the rotating photoconductive drum 1, and is introduced into the image fixing apparatus 5, in which the toner image on the recording medium P is fixed to the recording medium P. Thereafter, the recording medium P is discharged as a print or a copy from the image forming apparatus main assembly.

(F) Cleaning Process

After the separation of the recording medium P, the peripheral surface of the photoconductive drum 1 is cleaned by the cleaning apparatus 7; the toner particles remaining on the peripheral surface of the photoconductive drum 1 after the transfer are removed by the cleaning apparatus 7. Then, the cleaned portion of the peripheral surface of the photoconductive drum 1 is used again for image formation.

The printer in this embodiment employed the process cartridge 9, in which five processing components: the photoconductive drum 1, charge roller 2, developing device 3, cleaning apparatus 7, and conductive charging particle supplying means 8, were integrally disposed in a cartridge removably installable in the main assembly of the printer.

Here, a process cartridge means a cartridge in which a minimum of one processing means among the charging means, developing means, and cleaning means, and an image bearing member, are integrally disposed, and which is enabled to be removably mounted in the main assembly of an image forming apparatus.

(2) Photoconductive Drum 1

The photoconductive drum 1 in this embodiment was a photoconductive member having a charge injection layer as the surface layer. FIG. 2 schematically shows the laminar structure of the photoconductive drum used in this embodiment. This photoconductive drum 1 comprised an ordinary organic photoconductive drum and a charge injection layer 16 coated around the peripheral surface of the ordinary organic photoconductive drum to improve, in chargeability, the ordinary organic photoconductive drum. The ordinary organic photoconductive drum comprises an aluminum drum 11 as a base member, and four functional layers: undercoat layer 12, positive charge injection prevention layer 13, charge generation layer 14, and charge transfer layer 15, coated in layers around the peripheral surface of the aluminum drum 11 in the listed order.

The charge injection layer 16 is formed in the following manner. Microscopic particles 16*a* (approximately 0.03 $\mu$m in particle diameter) of $SnO_2$ as conductive particles, fluorinated resin (for example. Teflon (commercial name)) as a slip additive, a polymerization initiator, and the like, are dispersed in photo-curable acrylic resin, and the mixture is coated and photo-cured.

The essential property of the charge injection layer 16 is its surface resistance, In a charging method in which charge is directly injected, the reduction in the electrical resistance on the side to be charged improves the efficiency with which charge is exchanged. Further, when an object to be charged is a photoconductive member, it must be capable of retaining an electrostatic latent image for a predetermined length of time. Therefore, the volumetric resistance value of the charge injection layer 16 is desired to be in a range of $1\times10^{9}$–$1\times10^{14}$ (ohm.cm). In this embodiment, a charge injection layer having a volumetric resistance value of 1×1014 (ohm.cm) was employed.

Even when a photoconductive member is not provided with the charge injection layer 16, unlike the photoconductive drum 1 in this embodiment, the same effects as in this embodiment can be obtained as long as the volumetric resistance value of the charge transfer layer 15 is within the above described range. Further, the same effects can be obtained with the use of an amorphous silicon based photoconductive member, the surface layer of which has an approximate volumetric resistance value of $10^{13}$ ohm.cm (3) Charge Roller 2

The charge roller 2 is produced by forming a foamed elastic layer 2*b* around the peripheral surface of a metallic core 2*a*. The electrical resistance of the foamed elastic layer 2*b* is in the mid range. The medium resistance layer 2*b* contains resin (urethane, for example), electrically conductive particles (carbon black, for example), a foaming agent, and the like. It is in the form of a roller fitted around the metallic core 2*a*. If necessary, the peripheral surface of the charge roller 2 is polished to obtain an electrically conductive elastic roller 2 which is 12 mm in diameter and 200 mm in length.

The measured electrical resistance of the charge roller 2 in this embodiment was 100 kΩ. The resistance of the charge roller 2 was measured in the following manner. The charge roller 2 was placed in contact with an aluminum drum having a diameter of 30 mm, so that an overall load of 1 kg was applied to the metallic core 2*a* of the charge roller 2, and the resistance was measured by applying 100 V between the metallic core 2*a* and aluminum drum.

It is essential that the charge roller 2 is capable of functioning as an electrode. Thus, not only must the charge roller 2 be elastic enough to provide the optimal state of contact between itself and the photoconductive drum 1, but also low enough in electrical resistance to optimally charge a moving object. On the other hand, the charge roller 2 must be capable of preventing a voltage leak which occurs when an object to be charged has defects such as pinholes. Thus, in order to provided the charge roller 2 with satisfactory charging performance as well as voltage leak resistance, the electrical resistance of the charge roller 2 is desired-to be in a range of $10^{4}$–$10^{7}$ Ω.

As for the hardness of the charge roller 2, if it is too low, the charge roller 2 is unstable in shape, being therefore inferior in the manner in which it remains in contact with an object to be charged. On the other hand, if it is too high, not only does the charge roller 2 fail to remain in contact with an object to be charged, but also is inferior, at a microscopic level, in the manner in which the charge roller 2 remains in contact with the object to be charged. Thus, the hardness of the charge roller 2 is desired to be in a range of 25 degrees to 50 degrees in a hardness scale Asker C.

As the elastic material for the charge roller 2, there are rubbery substances created by dispersing the particles of electrically conductive substance, such as carbon black or metallic oxide, in EPDM, urethane, NBR, silicone rubber, IR, or the like, in order to adjust the electrical resistance of the elastic material. The electrical resistance of the elastic material can also be adjusted with the use of an ion conductive substance, instead of an electrically conductive substance. Further, it can also be adjusted with the use of a mixture of metallic oxide and an ion conductive substance.

(4) Conductive Charging Particles and Conductive Charging Particle Supplying Means 8

In this embodiment, zinc oxide particles, which are electrically conductive particles, and are $10^3$ ohm.cm in specific resistance and 1.5 $\mu$m in average particle diameter, are used as conductive charging particles m. The peripheral surface of the charge roller 2 is uniformly coated in advance before the charge roller 2 is put to use. The force which keeps the conductive charging particles m adhered to the peripheral surface of the charge roller 2 is mostly a mirror force. Therefore, in the initial layer of the conductive charging particles m on the charge roller 2, virtually no particle overlaps with the others, in terms of the radial direction of the charge roller 2.

The force which keeps adjacent two microscopic conductive particles is relatively small. Therefore, even if an attempt is made to adhere the conductive charging particles m to the peripheral surface of the charge roller 2 in a manner to overlap each other in terms of the radial direction of the charge roller 2, the particles other than those next to the peripheral surface of the charge roller 2 immediately fall off.

As for the material for the conductive charging particles m, electrically conductive inorganic particles such as particles of metallic oxide other than zinc oxide, a mixture of inorganic and organic particles, the surface treated versions of the preceding particles, and the like, can be used in addition to the aforementioned zinc oxide particles.

In order for electric charge to be efficiently exchanged through the conductive particles, the specific resistance of the conductive particles is desired to be no more than $10^{12}$ ohm.cm.

The specific resistance of the conductive particles were obtained by normalizing the electrical resistance of the conductive particles m measured using a tablet method. More specifically, 0.5 g of a conductive particle sample was placed between the top and bottom electrodes in a cylinder having a bottom area of 2.26 $mm^2$. Then, the electrical resistance of this sample was measured while applying a voltage of 100 V and a pressure of 15 kg between the top and bottom electrodes. Then, the specific resistance of the conductive particles was obtained by normalizing the thus obtained electrical resistance of the conductive particles.

For the uniformity of charge, the conductive particle diameter is desired to be no more than 50 $\mu$m. Incidentally, in this embodiment, when the conductive particles were agglomerated, the average diameter of the agglomerates was used as the particle diameter of the conductive particles. As for the measurement of the conductive particle diameter, no less than 100 conductive particles were picked out using an optical, or electron, microscope. Then, the volumetric particle size distribution was calculated based on the horizontal maximum cord length, and a 50% average particle diameter was used as the conductive particle diameter.

In order to prevent the conductive charging particles having fallen off the charge roller 2 from interfering with the exposing process for latent image formation, and also in consideration of the fact that a certain amount of the conductive charging particles are transferred from the photoconductive drum 1 to the recording medium, the conductive charging particles are desired to be colorless or white.

In this embodiment, the conductive charging particle supplying means 8 comprised a conductive charging particle supplying member 81 (m), a supporting member 82 for supporting the conductive charging particle supplying member 81 (m), a housing 83 in which the conductive particle supplying member 81 (m) is housed, and the like. It is placed above the charge roller 2, being structured so that the bottom surface of the conductive particle supplying member 81 (m) within the housing 83 can be placed in contact with, or moved away from, the upwardly facing portion of the peripheral surface of the charge roller 2.

The conductive particle supplying member 81 (m) can be placed in contact with, or moved away from, the charge roller 2 with the use of a magnetic coil or the like. In this embodiment, in order to supply the charge roller 2 with the conductive charging particles m, the conductive particle supplying member 81 (m) was placed in contact with the charge roller 2 during a period in which no image was formed and the charge roller 2 was rotated no less than once, with the use of a cam, with a predetermined timing, after the formation of every 300 images. The reason for supplying the conductive charging particles m while no image is formed is as follows. If the conductive charging particles m are oversupplied during an image forming period, the conductive charging particles m transfer from the charge roller 2 to the peripheral surface of the photoconductive drum 1, creating such problems as the blocking of exposure light, development voltage leak in the development station, or the like.

The conductive particle supplying member 81 (m) is a member (conductive charging particle chip) formed by agglutinating the conductive charging particles m into a solid chip with the use of bonding agent or the like. As it is placed in contact with the rotating charge roller 2, it is shaved like a piece of chalk. As a result, the peripheral surface of the charge roller 2 is coated with the conductive charging particles m in the portion of the conductive particle supplying member 81 (m) being shaved away.

More specifically, the conductive particle supplying member 81 (m) is a chip formed by agglutinating the conductive charging particles m such as zinc oxide or alumina powder with the use of binder resin. The actual procedure is as follows. Styrene-acrylic resin, as binding resin, is dissolved in ethanol at 5 wt. %; in terms of weight, seven parts of conductive charging particles m such as zinc oxide particles are mixed with one part of the ethanol solution of the binder resin. This solution is placed in a mold, and dried therein, producing the conductive particle supplying member 81(m), or a chip of solidly agglutinated conductive charging particles m.

In this embodiment, zinc oxide powder which is $3\times10^3$ ohm.cm in specific resistance and 1.5 $\mu$m in average particle diameter was employed as the conductive charging particles m to be supplied to the charge roller 2.

(5) Direct Injection Based Charging Method

As described previously, the charge roller 2 was rotationally driven so that in the charging station a, the peripheral surface of the charge roller 2 moves in the direction B counter to the moving direction A of the peripheral surface of the photoconductive drum 1. Thus, the charge roller 2 contacts the photoconductive drum 1 with the presence of a peripheral velocity difference between the two. The pressure nip between the charge roller 2 and photoconductive drum 1 constitutes the charging station a in which the conductive charging particles m are present between the peripheral surfaces of the charge roller 2 and photoconductive drum 1.

To the charge roller 2, more precisely, to the metallic core 2*a* of the charge roller 2, a predetermined charge bias is applied from a charge bias application power source S1. In this embodiment, a DC voltage of −700 V was applied as the charge bias.

In the charging station a, that is, the contact area (interface) between the charge roller 2 and photoconductive drum 1, as the charge roller 2 contacts the photoconductive drum 1, the conductive charging particles m on the peripheral surface of the charge roller 2 contact the peripheral surface of the photoconductive drum 1. Therefore, the lubricity of the conductive charging particles m make it easier for the charge roller 2 to rotate in spite of the presence of a peripheral velocity difference between the charge roller 2 and photoconductive drum 1. Further, the presence of the conductive charging particles m between the peripheral surfaces of the charge roller 2 and photoconductive drum 1 improves the state of contact between the two. In other words, the presence of the conductive charging particles m between the peripheral surfaces of the charge roller 2 and photoconductive drum 1 enables the charge roller 2 to evenly rub the peripheral surface of the photoconductive drum 1, improving the state of contact between the peripheral surfaces of the charge roller 2 and photoconductive drum 1 in terms of electrical conduction, and therefore, making it possible for electric charge to be directly exchanged between the two surfaces. In other words, the direct injection charging mechanism becomes the dominant charging system. Therefore, the photoconductive drum 1 is charged by the charge roller 2 with such a high level of efficiency that could not be achieved by a conventional charge-roller based charging method, which employed the charging mechanism based on electric discharge. As a result, the photoconductive drum 1 can be charged to a potential level virtually equal to the potential level of the voltage applied to the charge roller 2.

In other words, with the presence of the conductive charging particles m in the charging station a, the potential level of the bias necessary to be charged to the charge roller 2 to charge the photoconductive drum 1, as an object to be charged, has only to be virtually equal to the potential level to which the photoconductive drum 1 is to be charged, and electric charge can be directly injected into the photoconductive drum 1 to charge the photoconductive drum 1, without relying on electric discharge; the photoconductive drum 1 can be safely and efficiently charged.

In this embodiment, a DC voltage of −700 V was applied to the metallic core 2*a* of the charge roller 2. As a result, the peripheral surface of the photoconductive drum 1 was charged to a potential level virtually equal to the potential level of the applied voltage, or −700 V.

Next, the above described process will be described in slightly more detail.

The charge roller 2 and photoconductive drum 1 are placed in contact with each other, hypothetically penetrating each other to a certain depth, and form a charging nip with a width of N (mm).

The photoconductive drum 1 is in the form of a drum having a diameter of 30 mm. The surface velocity of the drum is set to Vd (mm/sec).

As for the moving direction of the peripheral surface of the charge roller 2 in the charging station a, the same direction as the moving direction of the peripheral surface of the photoconductive drum 1 was referred to as a positive direction, and the direction counter to the moving direction of the peripheral surface of the photoconductive drum 1 was referred to as a negative direction. The peripheral velocity of the charge roller 2 is set to Vc (mm/sec). To the metallic core 2*a* of the charge roller 2, a DC voltage of −700 V was applied. As a result, the peripheral surface of the photoconductive drum 1 was charged to a potential level equal to that of the applied voltage.

The coverage ratio Rc, which indicates the ratio of the portion of the peripheral surface of the charge roller 2 coated with the conductive charging particles m relative to the entirety of the peripheral surface of the charge roller 2, was obtained using the following method.

A piece of slide glass was placed in contact with the peripheral surface of the charge roller 2 under the same conditions as those under which the peripheral surfaces of the charge roller 2 and photoconductive drum 1 were placed in contact with each other, and the contact area was visually examined with the use of an optical microscope. The ratio of the white portion of the contact area relative to the entirety of the contact area was regarded as the coverage ratio. The whiteness varies among the samples. Therefore, in order to obtain an accurate coverage ratio of the charging roller 2, the whiteness (blackness) of the charge roller 2 and the whiteness of the conductive charging particles m were measured in advance, along with the whiteness of the peripheral surface of the charge roller 2, the coverage ratio of which was 50%.

When the color of the peripheral surface of the charge roller 2, as the base color, is nearly pure white, it is difficult to optically obtain the coverage ratio. Therefore, in such a case, it is possible to obtain the coverage ratio by identifying the substances with the use of an elementary analysis using fluorescent X-rays or the like. However, the elementary analysis is difficult to perform under the same condition as those (piece of slide glass was placed in contact with peripheral surface of charge roller 2) under which the coverage ratio is optically obtained. Therefore, it is necessary to compare in advance the results of the measurement obtained using an optical microscope, with those obtained through elementary analysis, in order to obtain the correlation between the two sets of the results.

Since the elastic layer of a charging member is formed of porous material, the peripheral surface of the charging member is uneven. However, when the peripheral surface of the charging member is actually in contact with the peripheral surface of the photoconductive drum, the charging member and photoconductive drum have hypothetically penetrated each other to certain depths; in other words, the surface portion of the charging member remains squashed by the peripheral surface of the photoconductive drum. Therefore, the peripheral surface of the charge roller remains in the optimal state of contact relative to the peripheral surface of the photoconductive drum even at a microscopic level.

In order to enable a charge injection type charging apparatus to uniformly charge an object, it is very important to place the peripheral surface of the charge roller uniformly in contact with the peripheral surface of the photoconductive drum even at a microscopic level. The essential parameters concerning the state of contact between the charge roller and photoconductive drum are as follows.

The most essential parameter which characterizes the present invention is the conductive charging particle coverage ratio Rc (100% equals a ratio of 1), that is, the ratio of the peripheral surface of the charge roller covered with the conductive charging particles m, relative to the entirety of the peripheral surface of the charge roller. In the early stage of the usage of a brand-new charging apparatus, even if the conductive charging particles m are not present on the peripheral surface of the charge roller 2, the charging roller 2 can inject electric charge into the peripheral surface of the photoconductive drum to charge it, as long as the peripheral surface of the charge roller 2 is in contact with the peripheral surface of the photoconductive drum. Therefore, the value of the conductive charging particle coverage ratio Rc has little to do with the uniformity with which the peripheral surface of the photoconductive drum is charged. However, as the usage of the brand-new charging apparatus continues, the transfer residual toner, external additives, paper dust, and/or the like, slip past the cleaning blade, and reach the charging station a, contaminating the peripheral surface of the charge roller. These contaminants are high in electrical resistance. Therefore, as they soil the peripheral surface of the charge roller, they interfere with the process in which electric charge is directly injected into the photoconductive drum from the peripheral surface of the charge roller. Thus, whether the conductive charging particles m are present or not is the essential factor which determines the uniformity with which the peripheral surface of the photoconductive drum is charged through charge injection. More specifically, the uniformity with which the peripheral surface of the photoconductive drum is charged is greatly influenced by the conductive charging particle coverage ratio.

Surface velocity of photoconductive drum 1: Vd (mm/sec)

Surface velocity of charge roller 2 (mm/sec)

Absolute value of the difference between the surface velocities of the photoconductive drum 1 and charge roller 2: |Vc−Vd|

Whether the moving direction of the peripheral surface of the charge roller is positive or negative relative to the moving direction of the peripheral surface of the photoconductive drum, the greater the peripheral velocity difference between the charge roller and photoconductive drum, the greater the size of the area of the peripheral surface (strictly speaking, conductive charging particles, or uncontaminated areas) of the charge roller, with which a given point of the peripheral surface of the photoconductive drum comes into contact. Therefore, virtually no point of the peripheral surface of the photoconductive drum remains untouched by the peripheral surface of the charge roller.

Contact width (width of nip in terms of rotational direction of charge roller) between the charge roller and object to be charged, in macroscopic terms: N (mm)

Macroscopically, the photoconductive drum 1 and charge roller 2 are in contact with each other, across a certain range in terms of the rotational direction of the photoconductive drum 1 or charge roller 2. Thus, the wider the contact width, the greater the size of the area of the peripheral surface of the charge roller, with which a given point of the peripheral surface of the photoconductive drum comes into contact while it passes through the contact area, and therefore, the more uniform the contact between the peripheral surfaces of the photoconductive drum and charge roller.

At this time, referring to FIG. 3, how the peripheral surface of the photoconductive drum is charged by being injected with electric charge through the contact between the peripheral surfaces of the photoconductive drum and charge roller will be described. This drawing is a phantom development of the contact area between the charge roller 2 and photoconductive drum 1, as seen from the charge roller side. For the simplification of the depiction, the conductive charging particles m on the peripheral surface of the photoconductive drum have been thinned.

It is assumed that as the photoconductive drum rotates, a given point P1 of the peripheral surface of the photoconductive drum moves rightward from the left side of the drawing and enters the charging station a (nip). Microscopically, unless the electrically conductive peripheral surface of the charge roller or a conductive charging particle comes into contact with the point P1, electric charge is not injected into the point P1. In the drawing, each conductive charging particle is contoured by a dotted line. For example, as the charge roller rotates, a point C1 of the surface of one of the conductive charging particles, by which the conductive charging particle makes contact with the photoconductive drum, moves leftward from the right side of the drawing and enters the charging station a, coming into contact with the point P1. As a result, electric charge is injected into the point P1. In FIG. 3, the hatched areas are the areas of the peripheral surface of the photoconductive drum, which have been charged through charge injection. In reality, not only a certain number of the conductive charging particles come into contact with the corresponding points of the peripheral surface of the photoconductive drum, and inject electric charge into them, charging them thereby, but also some of the areas of the peripheral surface of the charge roller come into contact with the corresponding areas of the peripheral surface of the photoconductive drum, and eject electric charge into them, charging them thereby. Further, the provision of the peripheral velocity difference increases the frequency of the contact.

Each of the above described parameters relates to the state of contact between the peripheral surfaces of the charge roller and photoconductive drum. More specifically, the product of the contact width between a charging member and an object to be charged, and the conductive charging particle coverage ratio, represents the effective contact area, in macroscopic terms, and multiplication of the value of this effective contact area by the value of the peripheral velocity difference produces a numerical value which represents the level of the contact between a given point of the peripheral surface of the photoconductive drum and the conductive charging particles. Here, the greater the numerical value, the better the state of contact between the peripheral surfaces of the charge roller and photoconductive drum, and therefore, the more uniform the charge given to the peripheral surface of the photoconductive drum. However, when this numerical value is smaller than 1, the peripheral surface of the photoconductive drum will be unsatisfactorily charged in terms of uniformity. Therefore, the structure arrangement for charge injection in this embodiment is desired to satisfy the following mathematical formula:

$$N \cdot Rc \cdot |Vc-Vd|/Vd \geqq 1.$$

Table 1 shows the evaluations, in terms of the uniformity of charge, of 1,000 copies produced using the above described image forming apparatus while varying the value of each of the above described parameters.

TABLE 1

| | N (mm) | Rc | Vc (mm/sec) | Vd (mm/sec) | \|Vc − Vd\|/Vd | N · Rc · \|Vc − Vd\|/Vd | Uniformity |
|---|---|---|---|---|---|---|---|
| 1 | 2 | 0.7 | −94 | 94 | 2 | 2.8 | G |
| 2 | 0.5 | 0.7 | −94 | 94 | 2 | 0.7 | F |
| 3 | 2 | 0.5 | −94 | 94 | 2 | 2 | G |
| 4 | 2 | 0.3 | −94 | 94 | 2 | 1.2 | G |
| 5 | 0.5 | 0.3 | −94 | 94 | 2 | 0.3 | F |
| 6 | 0.5 | 0.3 | −30 | 94 | 1.3 | 0.195 | NG |
| 7 | 2 | 0.5 | 50 | 94 | 0.47 | 0.47 | F |
| 8 | 2 | 0.8 | 84 | 94 | 0.1 | 0.16 | NG |
| 9 | 2 | 0.95 | 94 | 94 | 0 | 0 | NG |
| 10 | 2 | 0.5 | 188 | 94 | 1 | 1 | G |
| 11 | 2 | 0.5 | −188 | 188 | 2 | 2 | G |
| 12 | 0.5 | 0.5 | −10 | 188 | 1 | 0.26 | F |
| 13 | 0.5 | 0.35 | −10 | 188 | 1 | 0.175 | NG |

G: Good
F: Fair
NG: No good

The contact width N was varied by varying the distance of the hypothetical penetration of the charge roller and photoconductive drum into each other.

The conductive charging particle coverage ratio was varied by varying the state of the contact between the conductive particle supplying member 81 (m) and charge roller 2.

The peripheral velocities of the charge roller and photoconductive drum were varied independently from each other.

As described above, setting the above described parameters to such values that satisfy the mathematical formula ($N \cdot Rc \cdot |Vc-Vd|/Vd \geqq 1$) makes it possible to more uniformly charge the peripheral surface of the photoconductive drum through charge injection.

In this embodiment, the conductive charging particles m were supplied to the charge roller 2 by placing the conductive particle supplying member 81(m), in the form of a chip, in contact with the charge roller 2. However, the method for supplying the conductive charging particles m to the charge roller 2 does not need to be limited to the method in this embodiment. For example, the conductive charging particles m may be supplied, in the powder form, to the charge roller 2, or to the photoconductive drum 1, across the area of the peripheral surface on the downstream side with respect to the transfer station d, in terms of the rotational direction of the photoconductive drum.

<Embodiment 2>

In this embodiment, the electrical resistance of the peripheral surface of the photoconductive drum is not adjusted as it was in the first embodiment, and the present invention is applicable only when the volumetric resistivity of the outermost layer of the photoconductive drum is no less than $10^{14}$ (ohm.cm). Except for the aspects of the this embodiment which will be described next, this embodiment is identical to the first embodiment.

The photoconductive drum 1 used in this embodiment is similar to the photoconductive drum 1 in the first embodiment shown in FIG. 2, except that this photoconductive drum 1 lacks the charge injection layer 16, that is, the surface layer of the photoconductive drum 1 in the first embodiment. In other words, it is an ordinary organic photoconductive drum itself, which comprises an aluminum base drum 1, and four functional layers: undercoat layer 12, positive charge injection prevention layer 13, charge generation layer 14, and charge transfer layer 15, coated in layers on the peripheral surface of the aluminum drum base drum 11 in the listed order.

The electron mobility in the surface layer of this photoconductive drum is less than that of the photoconductive drum in the first embodiment. Therefore, when charging this photoconductive drum to the negative polarity by charge injection, it receives electrons less efficiently than the photoconductive drum 1 in the first embodiment. Therefore, under the same conditions as those described in the first embodiment, it is not charged as uniformly as the photoconductive drum in the first embodiment, by a charge injecting method.

When charging an object to the negative polarity, the mobility of electric charge, which significantly influences the characteristics of a charge injection mechanism, is actually the mobility of an electron, whereas when charging an object to the positive polarity, it is actually the mobility of a positive hole. In this embodiment, however, charge mobility was substituted with electrical resistance.

In order to raise the level of uniformity at which the photoconductive drum in this embodiment is charged by charge injection, it is necessary to improve the state of contact between the peripheral surfaces or the charge roller and photoconductive drum. In order to improve the state of contact between the peripheral surfaces of the charge roller and photoconductive drum, it is desired that the product of the above described parameters which affect the state of contact is twice or more than that in the first embodiment. In other words, it is desired that the following mathematical formula is satisfied:

$$N \cdot Rc \cdot |Vc-Vd|/Vd \geqq 2.$$

Table 2 shows the results of the evaluation, in terms of charge uniformity, of 1,000 copies made, varying the value of each parameter, with the use of the main assembly of the image forming apparatus in the first embodiment, in which the photoconductive drum in this embodiment was mounted.

TABLE 2

| | N (mm) | Rc | Vc (mm/sec) | Vd (mm/sec) | \|Vc − Vd\|/Vd | N · Rc · \|Vc − Vd\|/Vd | Uniformity |
|---|---|---|---|---|---|---|---|
| 1 | 2 | 0.8 | −94 | 94 | 2 | 3.6 | G |
| 2 | 0.5 | 0.8 | −94 | 94 | 2 | 0.8 | NG |
| 3 | 2 | 0.5 | −94 | 94 | 2 | 2 | F |
| 4 | 2 | 0.3 | −94 | 94 | 2 | 1.2 | NG |
| 5 | 1 | 0.8 | −141 | 94 | 2.5 | 2 | F |
| 6 | 1 | 0.7 | −141 | 94 | 2.5 | 1.75 | NG |
| 7 | 3 | 0.7 | −141 | 94 | 2.5 | 3.15 | G |

G: Good
F: Fair
NG: No good

Setting the parameters to the values associated with the satisfactory level of charge uniformity in Table 2 makes it possible to uniformly charge even a photoconductive drum with the surface layer unadjusted in electrical resistance.

Figure 4:
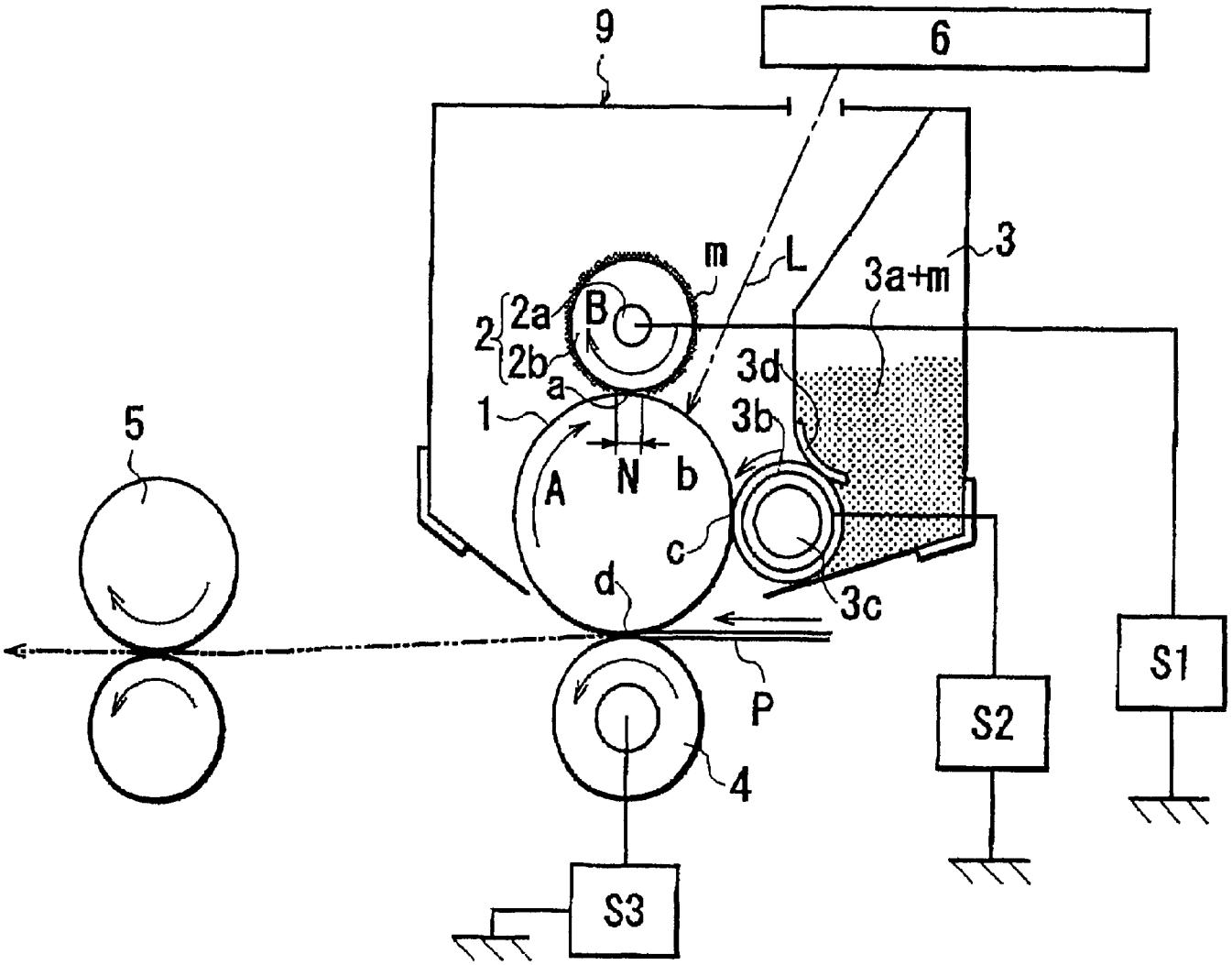
FIG. 4 is a schematic drawing for showing the general structure of the image forming apparatus in the third embodiment of the present invention.
Figure 5:
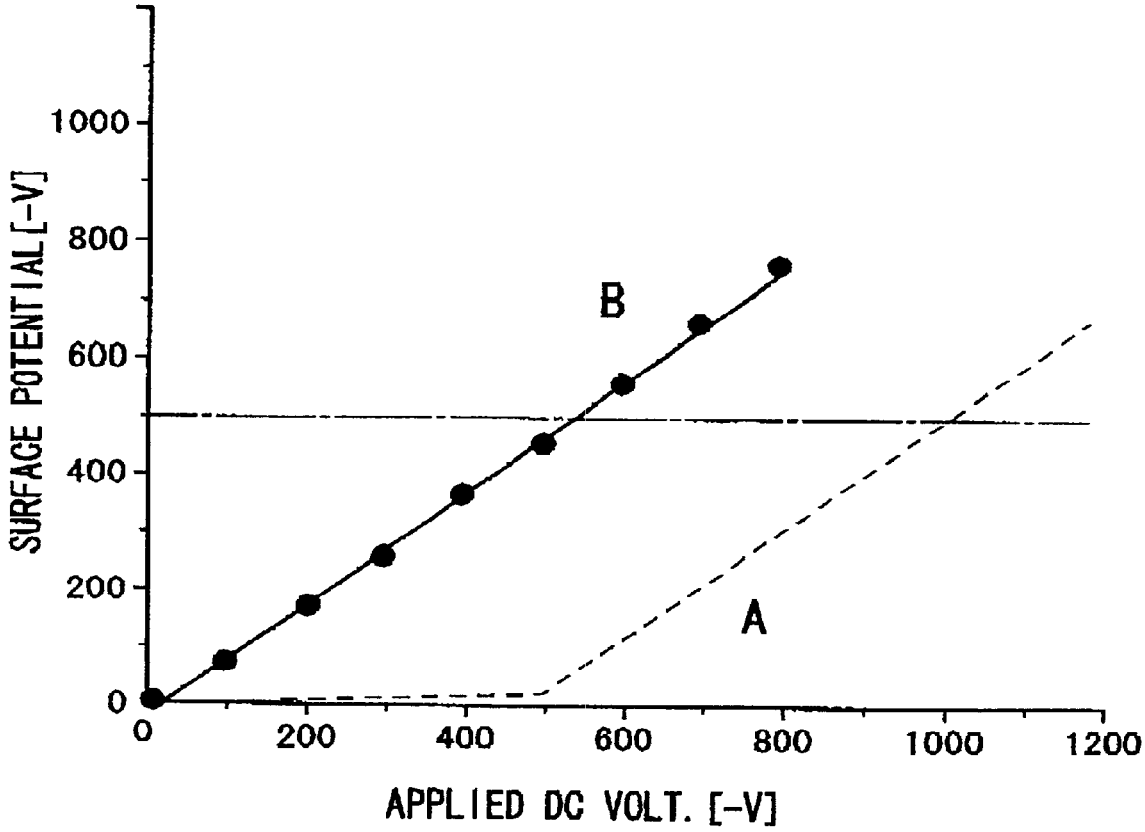
FIG. 5 is a graph for showing the characteristic of a charging method based on direct charge injection.

<Embodiment 3> (FIG. 4)

FIG. 4 is a schematic sectional view of the image forming apparatus in this embodiment, for showing the general structure thereof. The image forming apparatus in this embodiment is a cleaner-less (toner recycling) version of the printer in the first embodiment, that is, a modified version of the printer in the first embodiment created by eliminating the cleaning apparatus 7 thereof, along with the conductive particle supplying means 81 (m) thereof for supplying the conductive charging particles m to the charge roller 2. Therefore, in this image forming apparatus, the conductive charging particles m are supplied to the charge roller 2 by the developing device 3. Except for the aspects of this embodiment, which will be described next, this embodiment is identical to the first embodiment.

As a photoconductive drum, the drum in the first embodiment, the surface layer of which is a charge injection layer, is used.

The developing device 3 uses single-component magnetic toner, and is of a type which is not placed in contact with the photoconductive drum 1. It comprises a magnetic roll 3*c,* a development sleeve 3*b,* and a regulating blade 3*d.* The magnetic roll 3*c* is disposed within the hollow of the development sleeve 3*b.* The toner within the developing device 3 is conveyed by being layered on the peripheral surface of the sleeve 3*b.* While being conveyed by the sleeve 3*b,* the layer of the developer 3*a* is regulated in thickness by the regulating blade 3*d,* and as the layer of the toner 3*a* is regulated in thickness, the toner is electrically charged. As the charge roller 2 is further rotated, the layer of the toner 3*a* is introduced into the development station c, in which the toner 3*a* develops the electrostatic image having been formed on the photoconductive drum 1. In this embodiment, the weight average particle diameter (D4) of the toner 3*a* as developer was 7 $\mu$m. The toner 3*a,* or the developer, contain the conductive charging particles m, which had been admixed in advance into the toner 3*a* at a predetermined ratio. The conductive charging particles m were zinc oxide particles, which were 1.5 $\mu$m in average particle diameter, and had been admixed into the toner 3*a* at a weight ratio of 2 parts.

The conductive charging particles m in the developer 3*a* in the developing device 3 transfer by a proper amount onto the peripheral surface of the photoconductive drum 1, along with the toner 3*a,* in the transfer station c, when the electrostatic image on the peripheral surface of the photoconductive drum 1 is developed by the toner in the developing device 3, in the development station c.

In the transfer nip d, the toner image on the photoconductive drum 1 aggressively transfers onto the recording medium P due to the effect of the transfer bias, whereas the conductive charging particles m on the photoconductive drum 1 do not aggressively transfer onto the recording medium P because of their electrical conductivity, remaining practically adhered to the photoconductive drum 1.

Further, the printer is of a cleaner-less type, which does not have a cleaner dedicated for cleaning the photoconductive drum. Therefore, the above described conductive charging particles m remaining on the peripheral surface of the photoconductive drum 1 after image transfer are carried, as they are, by the movement of the peripheral surface of the photoconductive drum 1, to the charging station a, that is, the compression nip between the photoconductive drum 1 and charge roller 2 in which they adhere to the charge roller 2; they are supplied to the charge roller 2.

In other words, even if a certain amount of conductive charging particles m moves onto the photoconductive drum 1, as the printer is operated, the conductive charging particles m contained in the developer 3*a* in the developing device 3 continuously move onto the peripheral surface of the photoconductive drum 1, in the development station c, and are carried by the movement of the peripheral surface of the photoconductive drum 1, through the transfer station d, into the charging station c, in which they are supplied to the charge roller 2.

The conductive charging particles m which have fallen off the charge roller 2 are recovered by the developing device 3 by way of the photoconductive drum 1, mixing into the developer 3*a,* and are reused.

Since the printer is of a cleaner-less type, the transfer residual toner particles, that is, the toner particles remaining on the peripheral surface of the photoconductive drum 1 after image transfer, are carried, as they are by the movement of the peripheral surface of the photoconductive drum 1, to the charging station a, in which they adhere to, or enter, the charge roller 2. However, there are conductive charging particles m on the peripheral surface of the charge roller 2, in the charging station a, maintaining the high level of contact between the peripheral surfaces of the charge roller 2 and photoconductive drum 1, while minimizing the contact resistance between the two surfaces, even at the microscopic level, in spite of the presence of the transfer residual toner particles which have adhered to, or entered the charge roller 2. In other words, in spite of the contamination of the charge roller 2 by the transfer residual toner, it is assured that electric charge is directly and efficiently toner injected into the photoconductive drum 1 with the application of relatively low voltage to the charge roller 2, for a long period of time. Therefore, it is assured that the photoconductive drum 1 is uniformly charged without generating ozone for a long period of time.

The charge roller 2 and photoconductive drum 1 rotate in contact with each other with the presence of a peripheral velocity difference between them. Therefore, as the transfer residual toner particles arrive at the charging station a from the transfer station d, the charge roller 2 disturbs the transfer residual toner particles on the peripheral surface of the photoconductive drum 1, erasing the pattern in which the transfer residual toner particles were adhering to the peripheral surface of the photoconductive drum 1. Thus, the phenomenon that the patterns of the images formed during the preceding rotations of the photoconductive drum 1 appear as ghosts across the halftone areas of the currently formed image does not occur.

The transfer residual toner particles which have adhered to, or entered, the charge roller 2, are gradually expelled from the charge roller 2 onto the photoconductive drum 1. Then, they are carried by the movement of the peripheral surface of the photoconductive drum 1, to the developing station c, in which they are recovered by the developing device 3 for recycling; the peripheral surface of the photoconductive drum 1 is cleaned.

The developing/cleaning process is an integral combination of the development process and cleaning process, which is carried out in a cleaner-less image forming apparatus. More specifically, in a cleaner-less image forming apparatus, the area of the photoconductive drum 1 on which the toner particles are remaining after image transfer is charged during the immediately following image forming rotational cycle of the photoconductive drum 1, and is exposed again so that a latent image is formed thereon. Then, during the development of this latent image on the areas of the photoconductive drum 1 across which the residual toner particles remain, the residual toner particles are recovered by the fog removal bias, that is, the difference Vback in potential level between the DC voltage applied to the developing apparatus, and the surface charge of the photoconductive drum. In the case of a reversal development process such as the one used by the printer in this embodiment, this developing/cleaning process is carried out by the electric field which recovers the toner particles on the dark areas, in terms of potential level, of the peripheral surface of the photoconductive drum 1, onto the development sleeve, and the electric field which causes the toner particles on the development sleeve to adhere to the light areas, in terms of potential level, of the peripheral surface of the photoconductive drum 1.

The residual toner particles, that is, the toner particles which were left unused on the photoconductive drum 1 in the transfer station d, enter the charge roller 2 while being stirred up by the microscopic peaks and ridges (cell walls of foamed material) of the peripheral surface of the charge roller 2. However, the peripheral surface of the charge roller bears the conductive charging particles m as well as the transfer residual toner particles, being enabled to remain in contact with the photoconductive drum 1 in a desirable manner, and also to keep the contact resistance at a satisfactory level. Therefore, charge can be directly and satisfactorily injected into the photoconductive drum 1 to uniformly charge the photoconductive drum 1. As for the toner particles which have entered the charge roller 2, they do not penetrate deep into the charge roller 2, and are charged to the inherent polarity (negative polarity, in this embodiment) by the friction between the toner particles, and drum or conductive charging particles m. Then, they are expelled from the peripheral surface of the charge roller back onto the peripheral surface of the photoconductive drum, and are recovered by the developing device, or used for development, during the following development process.

Table 3 shows the results of the evaluation, regarding the charge uniformity, of 1,000 copies produced, which varying the values of the above described parameters, with the use of the above described image forming apparatus.

The image forming apparatus used in this embodiment was of a cleaner-less type. Therefore, substantial amounts of external additives and paper dust, in addition to the conductive charging particles and toner, were on the peripheral surface of the charge roller. Thus, simply measuring the whiteness of the peripheral surface of the charge roller was not sufficient for obtaining the accurate conductive charging particle coverage of the peripheral surface of the charge roller. Thus, an elementary analysis was also carried out with the use of a fluorescent X-ray spectrometer RIX3000 (Rigaku Co. Ltd.) to obtain the coverage.

TABLE 3

| | N (mm) | Rc | Vc (mm/sec) | Vd (mm/sec) | \|Vc − Vd\|/Vd | N · Rc · \|Vc − Vd\|/Vd | Uniformity |
|---|---|---|---|---|---|---|---|
| 1 | 3 | 0.5 | −94 | 94 | 2 | 3.0 | G |
| 2 | 0.5 | 0.5 | −94 | 94 | 2 | 0.5 | F |
| 3 | 2 | 0.5 | −94 | 94 | 2 | 2 | G |
| 4 | 2 | 0.3 | −94 | 94 | 2 | 1.2 | G |
| 5 | 0.5 | 0.3 | −94 | 94 | 2 | 0.3 | F |
| 6 | 0.5 | 0.3 | −30 | 94 | 1.3 | 0.195 | NG |
| 7 | 2 | 0.5 | 50 | 94 | 0.47 | 0.47 | F |
| 8 | 2 | 0.8 | 84 | 94 | 0.1 | 0.16 | NG |
| 9 | 2 | 0.95 | 94 | 94 | 0 | 0 | NG |
| 10 | 2 | 0.5 | 188 | 94 | 1 | 1 | G |
| 11 | 2 | 0.5 | −188 | 188 | 2 | 2 | G |
| 12 | 0.5 | 0.5 | −10 | 188 | 1 | 0.26 | F |
| 13 | 0.5 | 0.35 | −10 | 188 | 1 | 0.175 | NG |

G: Good
F: Fair
NG: No good

It is evident from the results of the evaluations given in Table 3 that setting the above described parameters related to the uniformity with which the peripheral surface of the photoconductive drum is charged through charge injection, to the values which satisfy the following mathematical formula:

$$N \cdot Rc \cdot |Vc - Vd|/Vd \geqq 1,$$

makes it possible to secure numerous paths, through which electric charge can be transferred from the peripheral surface of the charge roller onto the peripheral surface of the photoconductive drum, so that the peripheral surface of the photoconductive drum 1 is uniformly charged by charge injection, even when the transfer residual toner particles enter the charging station a.

With the repetition of the above described process, the photoconductive drum 1 can be charged through charge injection, while recycling the toner. According to the present invention, even in a cleaner-less image forming apparatus, the peripheral surfaces of the charge roller and photoconductive drum are kept in the optimal state of contact relative to each other for a long period time, and therefore, the peripheral surface of the photoconductive drum is uniformly charged, effecting excellent images, for a long period of time.

<Miscellanies>

1) The selection of the charge roller 2 as a contact charging member does not need to be limited to the charge rollers in the preceding embodiments.

In other words, a contact charging member may be different in shape and/or material from the charging roller 2 in the preceding embodiments. For example, a fur brush, or a piece of felt or fabric, way be used as a contact charging member. Further, for superior elasticity (flexibility) and electric conductivity, a contact charging member may be formed by layering different materials.

Further, such an elastic member as a fur brush, each bristle of which is elastic, may be used as a contact charging member. For example, a contact charging member may be a fur brush roller fabricated in the following manner: resistance-adjusted fibers (Rec of Unitika Ltd., or the like) are planted at a density of 155 thread/$mm^2$ to form 3 mm thick pile, and the pile is wrapped around a metallic core with a diameter of 6 mm.

2) The charge bias and development bias applied to the charge roller 2 and development sleeve 3*b,* respectively, may be a combination of DC and AC voltages.

The waveform of AC voltage is optional: it may be sinusoidal, rectangular, triangular, or the like. Further, it may be such a rectangular waveform that is formed by periodically turning on and off a DC power source. In other words, any bias may be used as long as its voltage value periodically changes.

3) The selection of an image exposing means for forming an electrostatic latent image does not need to be limited to a laser based scanning exposing means, such as the exposing means in the preceding embodiment, which forms a digital latent image. For example, it may be an ordinary analog image exposing means, or a light emitting element such as an LED. Further, it may be a combination of a light emitting element such as a fluorescent light, and a liquid crystal shutter In other words, any exposing means will suffice as long as it is capable of forming an electrostatic latent image in accordance with image formation data.

The photoconductive drum 1 may be substituted with an electrostatic dielectric member or the like. In such a case, an electrostatic latent image of an intended image is written by uniformly charging the surface of the dielectric member to a predetermined polarity and potential level, and then, selectively removing the charge.

4) In the preceding embodiments of the present invention, the developing device 3 was described as a reversal developing device which uses single-component magnetic toner. However, the prevent invention does not limit the developing device selection. For example, the present invention is also compatible with a normal developing device.

Generally speaking, various methods for developing an electrostatic latent image can be roughly categorized into four groups: a single-component noncontact group, a single-component contact group, a two-component contact group, and a two-component noncontact group. In the single-component noncontact group, a single-component magnetic toner or a single component nonmagnetic toner is coated on a developer bearing/conveying member, such as a development sleeve, with the use of a blade or the like; or magnetic force, respectively, and conveyed to a development station, in which an electrostatic latent image on the peripheral surface of an image bearing member is developed by the noncontact application of the toner on the developer bearing/conveying member to the image bearing member. In the single-component contact group, an electrostatic latent image on the peripheral surface of an image bearing member is developed by the contact application of the toner coated, as described above, on a developer bearing/conveying member, to the image bearing member. In the two-component contact group, a two-component developer, which is a mixture of toner particles and magnetic carrier particles, is conveyed by magnetic force, and an electrostatic latent image is developed by the contact application of the two-component developer to the image bearing member. In the two-component noncontact group, an electrostatic latent image is developed by the noncontact application of the above described two-component developer to the image bearing member.

5) The transferring means selection does not need to be limited to the transfer roller 4. For example, the transfer roller 4 may be substituted with a transfer belt.

6) Not only is the present invention is compatible with a monochromatic image forming apparatus, but also it is compatible with an image forming apparatus which employs an intermediary transferring member, such as a transfer drum or transfer belt, and is capable of forming multicolor images or full-color images, through a multilayer transfer process or the like.

As described above, according to the present invention, it is possible to provide a charging apparatus which is capable of uniformly charging an object for a long period of time, with the use of an injection type charging method, that is, a direct charging method, which is virtually free of byproducts such as ozone.

Also according to the present invention, it is possible to provide a charging apparatus which is capable of uniformly charging even an object unadjusted in the electrical resistance of its surface layer, for a long period of time, with the use of an injection type charging method, that is, a direct charging method, which is virtually free of byproducts such as ozone.

While the invention has been described with reference to the structures disclosed herein, it is not confined to the details set forth, and this application is intended to cover such modifications or changes as may come within the purposes of the improvements or the scope of the following Claims.

What is claimed is:

1. A charging device comprising:

a charging member configured and positioned to electrically charge a member to be charged, which is adapted to form a nip with the member to be charged that has a surface layer having a volume resistivity of $1\times10^{9}$–$1\times10^{14}$ Ωcm, said charging member having an elastic member and being movable with a peripheral speed difference relative to the member to be charged; and electroconductive particles carried on said charging member to the nip, wherein the peripheral speed Vd (mm/sec) of the member to be charged, the peripheral speed Vc (mm/sec) of said charging member, the width N (mm) of the nip measured in a moving direction of said charging member, and the coverage ratio Rc of said electroconductive particles on said charging member, satisfy:

$$N \cdot Rc \cdot |Vc-Vd|/Vd \geqq 1.$$

2. A device according to claim 1, wherein said charging member is in the form of a roller.

3. A device according to claim 1, wherein said elastic member has a surface foam layer.

4. A device according to claim 1, wherein said charging member rotates in a direction to provide a counter directional peripheral movement relative to the member to be charged at said nip.

5. A charging device comprising;

a charging member configured and positioned to electrically charge a member to be charged which is adapted to form a nip with the member to be charged which has a surface layer having a volume resistivity of not less than $1\times10^{14}$ Ωcm, said charging member having an elastic member and being movable with a peripheral speed difference relative to the member to be charged; and electroconductive particles carried on said charging member to the nip; and wherein the peripheral speed Vd (mm/sec) of the member to be charged, the peripheral speed Vc (mm/sec) of said charging member, the width N (mm) of the nip measured in a moving direction of said charging member, and the coverage ratio Rc of said electroconductive particles carried on said charging member, satisfy:

$$N \cdot Rc \cdot |Vc-Vd|/Vd \geqq 2.$$

6. A device according to claim 5, wherein said charging member is in the form of a roller.

7. A device according to claim 5, wherein said elastic member has a surface foam layer.

8. A device according to claim 5, wherein said charging member rotates in a direction to provide a counter directional peripheral movement relative to the member to be charged at said nip.

9. A process cartridge detachably mountable to a main assembly of an image forming apparatus, said process cartridge comprising:

a member to be charged which has a surface layer having a volume resistivity of $1\times10^{9}$–$1\times10^{14}$ Ωcm;

a charging member configured and positioned to electrically charge said member to be charged which is adapted to form a nip with said member to be charged, said charging member having an elastic member and being movable with a peripheral speed difference relative to said member to be charged; and electroconductive particles carried on said charging member to the nip; and wherein the peripheral speed Vd (mm/sec) of said member to be charged, the peripheral speed Vc (mm/sec) of said charging member, the width N (mm) of the nip measured in a moving direction of said charging member, and the coverage ratio Rc of said electroconductive particles carried on said charging member, satisfy:

$$N \cdot Rc \cdot |Vc-Vd|/Vd \geqq 1.$$

10. A process cartridge according to claim 9, further comprising developing means for developing an electrostatic image formed on said member to be charged with developer, said developing means being capable of effecting a collecting operation for collecting the developer remaining on said member to be charged.

11. A process cartridge according to claim 10, wherein said developing means is capable of effecting the collecting operation simultaneously with a developing operation.

12. A process cartridge according to claim 10, wherein said electroconductive particles are supplied from said developing means to said member to be charged together with the developer, and the developer with said electroconductive particles are fed to said nip.

13. An image forming apparatus comprising:

a member to be charged which has a surface layer having a volume resistivity of $1\times10^{9}$–$1\times10^{14}$ Ωcm;

a charging member configured and positioned to electrically charge a member to be charged which is adapted to form a nip with the member to be charged, said charging member having an elastic member and being movable with a peripheral speed difference relative to the member to be charged; and electroconductive particles carried on said charging member to the nip; and wherein the peripheral speed Vd (mm/sec) of the member to be charged, the peripheral speed Vc (mm/sec) of said charging member, the width N (mm) of the nip measured in a moving direction of said charging member, and the coverage ratio Rc of said electroconductive particles on said charging member, satisfy:

$$N \cdot Rc \cdot |Vc-Vd|/Vd \geqq 1.$$

14. An apparatus according to claim 13, further comprising developing means for developing an electrostatic image formed on the member to be charged with developer, said developing means being capable of effecting a collecting operation for collecting the developer remaining on the member to be charged.

15. An apparatus according to claim 14, wherein said developing means is capable of effecting the collecting operation simultaneously with a developing operation.

16. An apparatus according to claim 14, wherein said electroconductive particles are supplied from said developing means to the member to be charged together with the developer, and the developer with said electroconductive particles are fed to said nip.

* * * * *

UNITED STATES PATENT AND TRADEMARK OFFICE

CERTIFICATE OF CORRECTION

PATENT NO. : 6,788,911 B2
DATED : September 7, 2004
INVENTOR(S) : Harumi Ishiyama et al.

It is certified that error appears in the above-identified patent and that said Letters Patent is hereby corrected as shown below:

Column 1,
Line 43, “and,” should read -- and --.
Line 46, “be” should read -- to be --.

Column 6,
Line 4, “example.” should read -- example, --.
Line 9, “resistance,” should read -- resistance. --.
Line 59, “desired-to” should read -- desired to --.

Column 7,
Line 44, “were” should read -- was --.

Column 9,
Line 16, “make” should read -- makes --.

Column 15,
Line 54, “contain” should read -- contains --.

Column 19,
Line 51, “shutter” should read -- shutter. --.

Column 20,
Line 53, “Claims.” should read -- claims. --.

Column 21,
Line 15, “comprising;” should read -- comprising: --.

UNITED STATES PATENT AND TRADEMARK OFFICE

CERTIFICATE OF CORRECTION

PATENT NO. : 6,788,911 B2
DATED : September 7, 2004
INVENTOR(S) : Harumi Ishiyama et al.

It is certified that error appears in the above-identified patent and that said Letters Patent is hereby corrected as shown below:

Column 22,
Lines 21 and 56, "are" should read -- is --.

Signed and Sealed this

Twenty-eighth Day of December, 2004

JON W. DUDAS
*Director of the United States Patent and Trademark Office*